US007617622B2

(12) United States Patent
Elias

(10) Patent No.: US 7,617,622 B2
(45) Date of Patent: Nov. 17, 2009

(54) METHOD AND APPARATUS FOR CONVEYING UNIQUE VISUAL COMMUNICATION

(76) Inventor: Brian K. Elias, 8271 Old Woods Ct., Springboro, OH (US) 45066

( * ) Notice: Subject to any disclaimer, the term of this patent is extended or adjusted under 35 U.S.C. 154(b) by 458 days.

(21) Appl. No.: 11/084,912

(22) Filed: Mar. 21, 2005

(65) Prior Publication Data

US 2005/0160650 A1 Jul. 28, 2005

Related U.S. Application Data

(63) Continuation of application No. 10/429,504, filed on May 5, 2003, now Pat. No. 6,868,627, which is a continuation of application No. 09/814,191, filed on Mar. 21, 2001, now abandoned, which is a continuation-in-part of application No. 09/448,228, filed on Nov. 24, 1999, now abandoned.

(60) Provisional application No. 60/109,948, filed on Nov. 25, 1998.

(51) Int. Cl.

| | |
|---|---|
| ***G09F 3/00*** | (2006.01) |
| ***B65D 85/00*** | (2006.01) |
| ***E04B 7/00*** | (2006.01) |
| ***B42D 15/00*** | (2006.01) |

(52) U.S. Cl. ..... 40/306; 40/324; 206/459.1; 206/459.5; 52/105; 283/81

(58) Field of Classification Search ..... 40/306, 40/324; 283/81; 206/459.1, 459, 5; 52/105
See application file for complete search history.

(56) References Cited

U.S. PATENT DOCUMENTS 1,825,996 A 10/1931 Ehlenfeld
2,013,617 A 9/1935 Werfel
2,024,889 A 12/1935 Simeone
2,120,403 A 6/1938 Godfrey
2,587,147 A 2/1952 Guion et al.
3,484,976 A 12/1969 Shea
3,730,379 A 5/1973 Brown
3,750,317 A 8/1973 Morgan
4,322,016 A 3/1982 Barrash
4,380,129 A 4/1983 Barrash
RE31,702 E 10/1984 Brown
4,643,454 A 2/1987 Ondis
4,759,139 A 7/1988 Ricks
4,846,504 A * 7/1989 MacGregor et al. ..... 283/102
4,880,137 A 11/1989 Wells
4,901,457 A 2/1990 Chandler
5,154,448 A 10/1992 Griffin et al.
5,301,802 A 4/1994 Nemeroff
5,316,166 A 5/1994 Pavely et al.
5,329,713 A 7/1994 Lundell
5,358,117 A 10/1994 Adams
5,358,770 A 10/1994 Evans
5,386,795 A 2/1995 Bartholomew (Continued)

*Primary Examiner*—Lesley D Morris
*Assistant Examiner*—Syed A Islam
(74) *Attorney, Agent, or Firm*—Baker & Daniels LLP

(57) ABSTRACT

An apparatus and related method for conveying information associated with containers. The apparatus comprises a container supporting modification means which when selectively altered effectively changes the appearance of the container such that a unique visual communication is produced. The related method comprises selectively altering the modification means supported by the container thereby providing a unique visual communication.

7 Claims, 10 Drawing Sheets

U.S. PATENT DOCUMENTS 5,492,077 A 2/1996 Rose
5,560,610 A * 10/1996 Behm et al. ..... 273/269
5,676,401 A 10/1997 Witkowski et al.
5,704,144 A 1/1998 Groth
5,799,815 A 9/1998 Lang
5,803,504 A 9/1998 Deshiens et al.
D412,938 S 8/1999 Kesselring et al.
5,992,892 A * 11/1999 Schaefer et al. ..... 283/81
6,053,349 A 4/2000 Griggs, Jr. et al.
6,086,702 A 7/2000 Rea
6,244,456 B1 6/2001 Hanlon
6,455,119 B2 9/2002 Carides et al.
6,594,927 B2 7/2003 Witkowski

* cited by examiner

METHOD AND APPARATUS FOR CONVEYING UNIQUE VISUAL COMMUNICATION

CROSS-REFERENCE TO RELATED APPLICATIONS

This application is a continuation of U.S. patent application Ser. No. 10/429,504, filed May 5, 2003 now U.S. Pat. No. 6,868,627, which is a continuation of U.S. patent application Ser. No. 09/814,191, filed Mar. 21, 2001 now abandoned, which is a continuation-in-part of U.S. patent application Ser. No. 09/448,228, filed Nov. 24, 1999 now abandoned, which claims priority to U.S. Provisional Application Ser. No. 60/109,948, filed Nov. 25, 1998, all of which are expressly incorporated herein by reference.

BACKGROUND OF THE INVENTION

1. Field of the Invention

The present invention relates to containers and container labels, and more particularly, to containers and container labels which can be conveniently modified to provide simple and effective ways for users to visually personalize, distinguish, mark or communicate information via the containers themselves, or their associated labels.

2. Description of the Prior Art

Typical construction and labeling of containers does not provide means for visually communicating unique or identifying information. Users of a container often have the need to visually distinguish their container from another of the same brand and name, for example, to prevent accidental consumption of a beverage by someone other than the user of a container, or to indicate the owner of a container to avoid misidentification; to record information regarding the contents of the container, for example date of purchase, date container was first opened, volume of the container's contents consumed or remaining, amount of solute or solvent in the container; and to effect other visual signals, for example to indicate to a bar tender or server that the container is empty or near empty and another full container having the same contents is desired.

Traditional means used to visually personalize, distinguish, mark or communicate information via a container or its associated label involve the permanent physical marking or destruction of the container label. This way of communicating is both inconvenient and inconsistent, as a device for marking the container is required and uniformity of marking location is non-existent. Alternate means, as disclosed in U.S. Pat. No. 5,704,144 to Groth and U.S. Design Pat. No. 412,938 to Kesselring et al., require the affixation of an identification tag to the container. Such traditional marking means are typically expensive and do not permit convenient customization by the end user.

Accordingly, there remains a need for a method and apparatus for effecting easy visual communication by modifying the appearance of a container or container label.

SUMMARY OF THE INVENTION

A container in accordance with an illustrative embodiment of the present invention includes a substantially cylindrical wall of sheet material. Opposing upper end and lower end walls are connected to opposite ends of the cylindrical wall. A tab is rotatably and pivotally attached at a connection point proximate to the center of the upper end wall. The upper end wall includes a tear portion, the tab being configured to pivot and engage the tear portion to define an opening within the upper end wall. The opening is positioned intermediate the connection point and the side wall and includes an axis intersecting the connection point. A plurality of signals, or visual indicia, illustratively comprised of letters, numbers, words, names, symbols or other graphic representations are disposed in a series and radially outwardly from the connection point of the tab. The visual indicia are circumferentially aligned along a path of rotation of the tab.

The visual indicia may be imprinted on the container with ink or other marking means, or alternatively, die cut or embossed into the container during manufacture. The tab supports an indicator selectively moveable into alignment with the series of visual indicia. More particularly, when the tab is rotated, the indicator moves circumferentially across the upper end wall of the container. As the tab is rotated, the indicator may be selectively positioned in alignment with one of the visual indicia located on the container. The positioning of the indicator in alignment with one of the visual indicia provides a signal or unique visual communication.

A further illustrative embodiment of the present invention comprises a container as described above, wherein the tab is pivotally moved into substantial perpendicular disposition with the upper end wall of the can container. This movement is effected by manually pulling an outer edge of the tab upwardly away from the upper end wall of the can into the aforementioned substantial perpendicular disposition. The resultant positioning of the tab effects a unique visual communication. This communication may effect an order signal to a bar tender or server that the container is empty or near empty and that another full container having the same or similar contents is desired.

In a related illustrative embodiment, the tab is modified or shaped to include visual indicia which further emphasizes the order signal to a bar tender or server that the container is empty or near empty and that another full container having the same contents is desired. The visual indicia on the tab may consist of a mark, shape, incising, imprint, color, depression, cut, mold, impression, etc. visually forming a symbol, number, letter, word, name, graphic, or other visual cue. In a further illustrative embodiment, the modification or shaping of the tab is accomplished by modifying or shaping the underside of the tab only, such that the signal effected by the tab is only visible when the tab is upwardly extended away from the upper end wall of the container.

A further illustrative embodiment of the present invention comprises a container label formed from a material sheet. A first plurality of visual indicia are disposed in a series along a portion of the material sheet. The first plurality of visual indicia are individually covered with substantially opaque non-water soluble scratch-off layers. A second plurality of visual indicia visually distinguishable from the first plurality of visual indicia are overprinted atop the respective scratch-off layers. In an alternative embodiment, the second plurality of visual indicia may be printed aside each of the scratch-off layers. When a user of the label scratches off one or more of the scratch-off layers, a unique visual communication is provided.

Another embodiment of a container label in accordance with this invention is formed from a material sheet having a plurality of fingers along one or more of the material sheet's outer edges. The fingers are detachable from the material sheet by tearing them away along points of attachment. The points of attachment are preferably score lines for weakening the fingers for removal from the material sheet. Alternatively, the points of attachment may comprise a thinned wall or perforated line to weaken the fingers for removal from the material sheet. Additionally, the adhesive attaching the label to its container may be applied minimally, or not at all, to the fingers to thus weaken the fingers for removal from the material sheet. Associated with the fingers are a series of visual indicia comprised of letters, numbers, words, names, symbols or other graphic representation illustratively aligned in parallel with said fingers. When a user of the container label removes one or more of the fingers, a unique visual communication is provided.

Therefore, it is an object of the invention to provide an apparatus associated with a container for providing a unique visual communication.

It is an additional object of the invention to provide such an apparatus which may be readily modified by the end user to effectively change the appearance thereof.

It is a further object of the invention to provide such an apparatus which may be readily modified by the end user to visually distinguish the container from other like containers.

It is an additional object of the invention to provide such an apparatus which may be readily modified by the end user to record information regarding the contents of the container, including date of purchase, date the container was first opened, volume of the containers contents either consumed or remaining, or concentration of a solute or solvent contained within the container.

It is a further object of the invention to provide such an apparatus which may be readily modified by the end user to signal a bar tender or server that the container is empty or near empty and another full container having the same contents is desired.

Other objects and advantages of the invention will be apparent from the following description, accompanying drawings and appended claims.

DETAILED DESCRIPTION OF THE DRAWINGS

Figure 1:
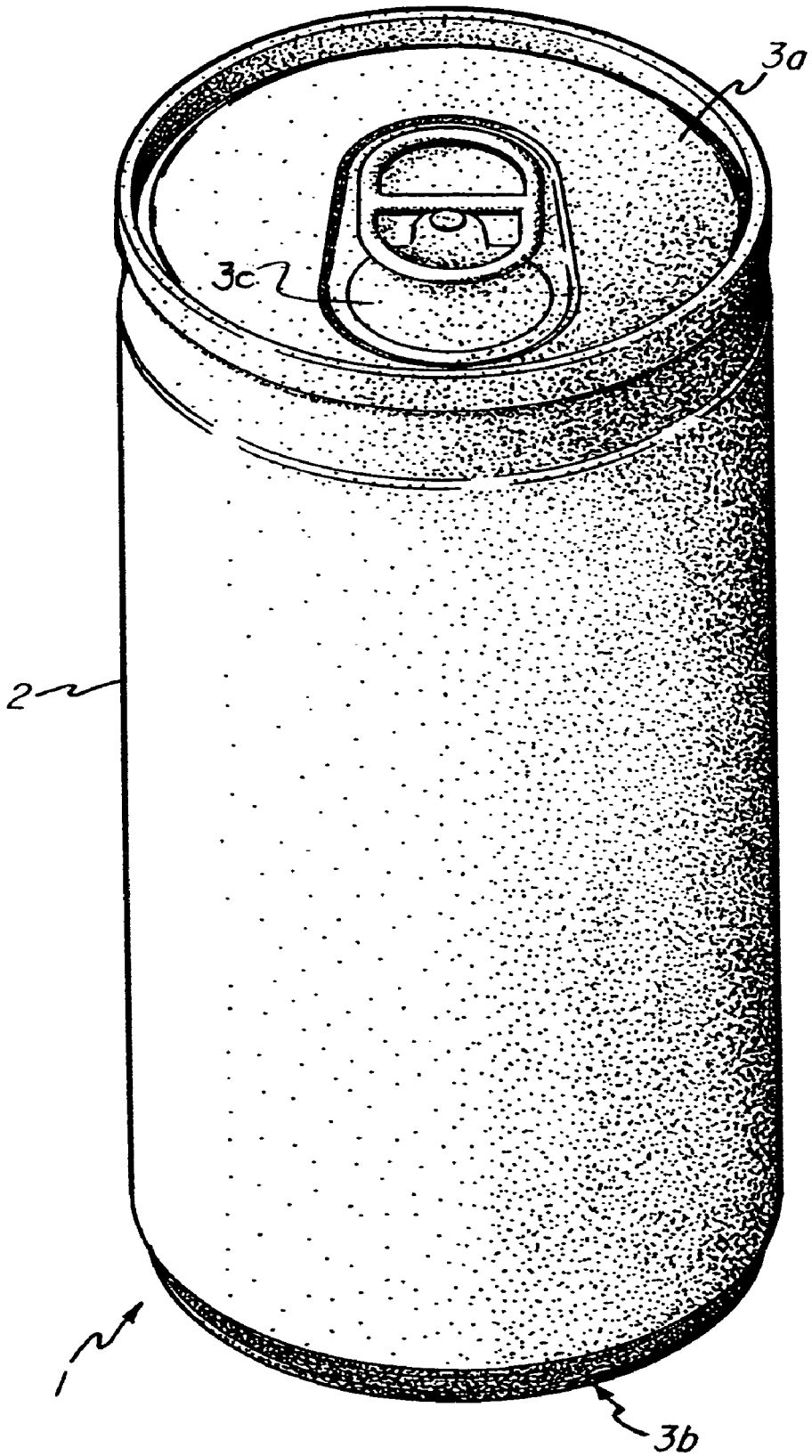
FIG-1 PRIOR ART
FIG. 1 is a perspective view of a conventional easy opening can container.

FIG. 1 illustrates an easy opening container 1 similar in type to that disclosed in U.S. Pat. No. 3,730,379 to Brown which is expressly incorporated herein by reference. While an easy opening container 1 is used in the following description, it is to be understood that this is for illustrative purposes only and in no way limits the scope of the invention. The container 1 includes a substantially cylindrical side wall 2 preferably formed of sheet material. Upper and lower end walls 3*a* and 3*b* are preferably formed from sheet material and connected to opposing ends of the side wall 2.

Figure 2:
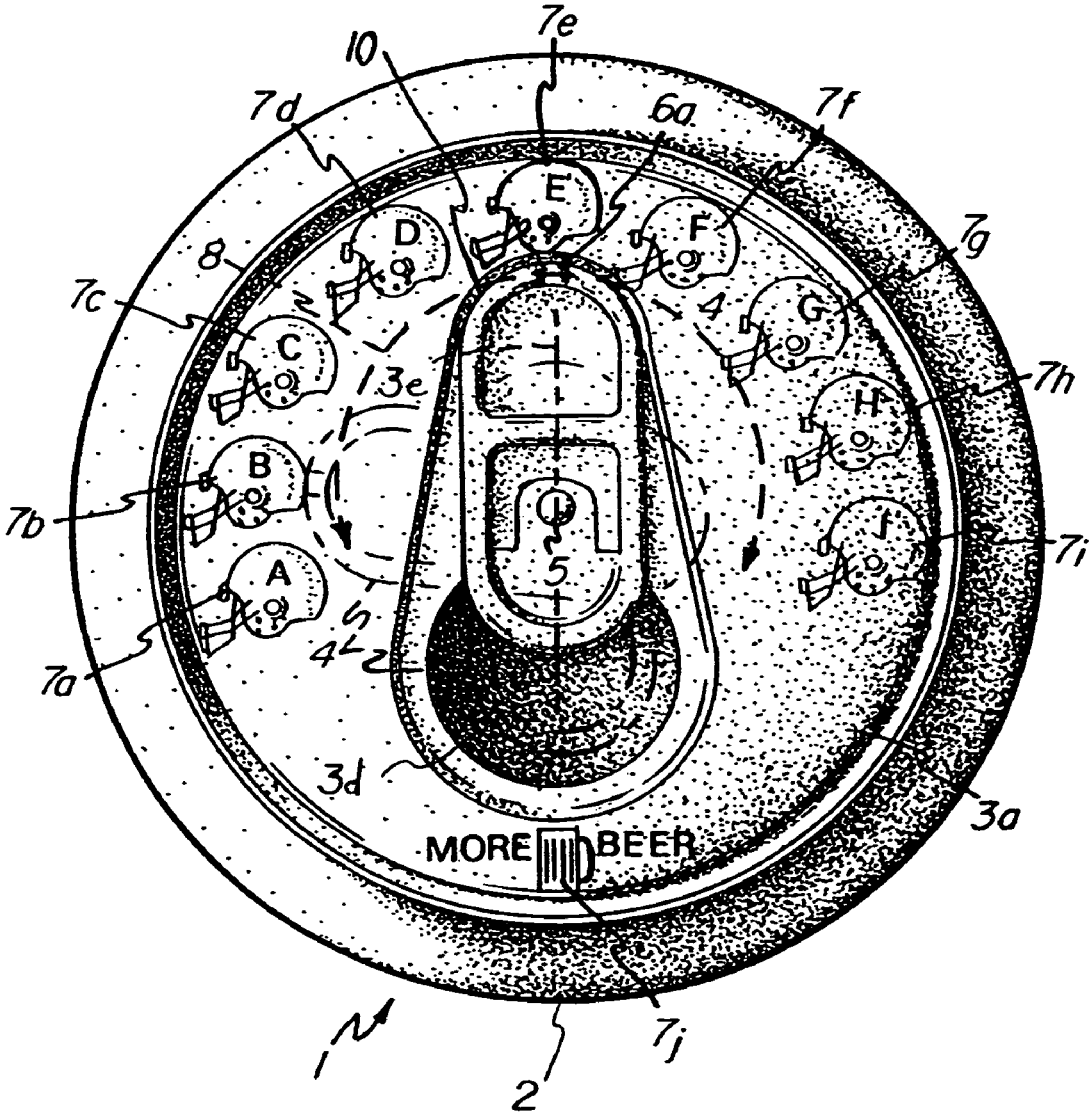
FIG. 2 is a top plan view of an easy opening can container in accordance with an illustrative embodiment of the present invention.

Referring now to FIGS. 1 and 2, a tab 4 is rotatably and pivotally attached at a connection point 5 proximate to the center of the upper end wall 3*a*. The upper end wall 3*a* includes a tear portion 3*c* which is configured to be engaged by, and pivoted downwardly by, the tab 4 to define an opening 3*d*. The opening 3*d* is illustratively positioned intermediate the connection point 5 and the side wall 2 and includes an axis 3*e* intersecting the connection point. The rotatable tab 4 has an indicator 6*a* preferably comprised of a narrow linear depression formed in the rotatable tab 4 proximate to the end thereof. The indicator 6*a* may comprise a mark, shape, depression, cut, notch, mold, bend, aperture or other formable indicator, but is not limited thereto.

A plurality of signals or visual indicia 7*a*-7*j* are illustratively die cut or embossed into the upper end wall 3*a*. Alternatively, the plurality of visual indicia 7*a*-7*j* may be imprinted on the upper end wall 3*a* with ink or other marking means. Each of the plurality of visual indicia 7*a*-7*j* is illustratively comprised of a unique graphical image. Illustratively, the visual indicia 7*a*-7*j* comprise a plurality of visually appealing symbols. The visual indicia 7*a*-7*j* include identification indicia 7*a*-7*i* configured to provide an identification signal conveying identification information, and an order or request indicia 7*j* configured to provide an order signal conveying the desire for more beverage. It should be appreciated that any unique visual indicia, such as letters, numbers, words, names, or symbols or other graphic representation may be utilized. The plurality of visual indicia 7*a*-7*j* are illustratively disposed in a series on the upper end wall 3*a* radially outwardly from the connection point 5 of the rotatable tab 4. The plurality of visual indicia 7*a*-7*j* are circumferentially spaced and substantially radially aligned with a path of rotation 8 of the indicator 6*a*. Each of the identification indicia 7*a*-7*i* (but not the request indicia 7*j*) is illustratively equally radially spaced along the arc. The request indicia 7*j* is perceptually distinct, and illustratively visually distinguished, from the plurality of identification indicia 7*a*-7*i*. More particularly, the request indicia 7*j* is illustratively positioned in spaced relation to the remaining visual indicia 7*a*-7*i* to be readily identifiable and spatially distinguished therefrom.

Referring further to FIGS. 1 and 2, when the rotatable tab 4 is rotated by a user of the container 1, the rotatable tab 4 moves the indicator 6*a* circumferentially along the path of rotation 8 above the upper end wall 3*a* of the container 1. As the rotatable tab 4 is rotated, the indicator 6*a* of the rotatable tab 4 may be selectively positioned in alignment with any one of the plurality of visual indicia 7*a*-7*j* located on the upper end wall 3*a* of the container. The positioning of the indicator 6*a* in alignment with any one of the plurality of visual indicia 7*a*-7*j* provides a unique visual communication.

In operation, the illustrative embodiment of the present invention may operate to identify or distinguish the appearance of the container 1 from other like containers, so as to indicate ownership (i.e., identification signal). It may also signal the user's desire for another container 1 having the same contents to an attending bar tender or server (i.e., order signal).

More particularly, alignment of the indicator 6*a* of the tab 4 with the request indicia 7*j* signals to others that another beverage container 1 is desired. As such, the request indicia 7*j* may comprise any indicia or symbol facilitating the conveyance of such a request, such as the words "MORE BEER" or the graphical representation of a beer mug. A beverage consumer initially opens the container in a conventional manner by pivoting an outer edge 10 of the tab 4, proximate the indicator 6*a*, upwardly so that the tab 4 forces the tear portion 3*c* of the upper end wall 3*a* downwardly to create the opening 3*d*. In a conventional manner, the tab 4 is then pivoted downwardly to a position substantially parallel to the upper end wall 3*a*. After consuming most or all of the beverage from within the container 1, the user rotates the tab 4 from a first position substantially parallel to the axis 3*e* and substantially intermediate the opening 3*d* and the side wall 2, to a second position angularly offset from the first position and aligned with the request indicia 7*j* which is spatially offset from identification indicia 7*a*-7*i*.

Alternatively, the visual indicia 7*a*-7*j* as aligned with the indicator 6*a* may operate to convey information pertaining to the contents of the container, for example, the date of purchase, the date the container was first opened, the volume of the contents of the container either consumed or remaining, or the concentration of a solute or solvent contained within the container. However, it should be appreciated that the selected visual indicia may be used to convey any other communication, for example, "I Love You", "Interested", "Not Interested", "Finished", etc.

Figure 3:
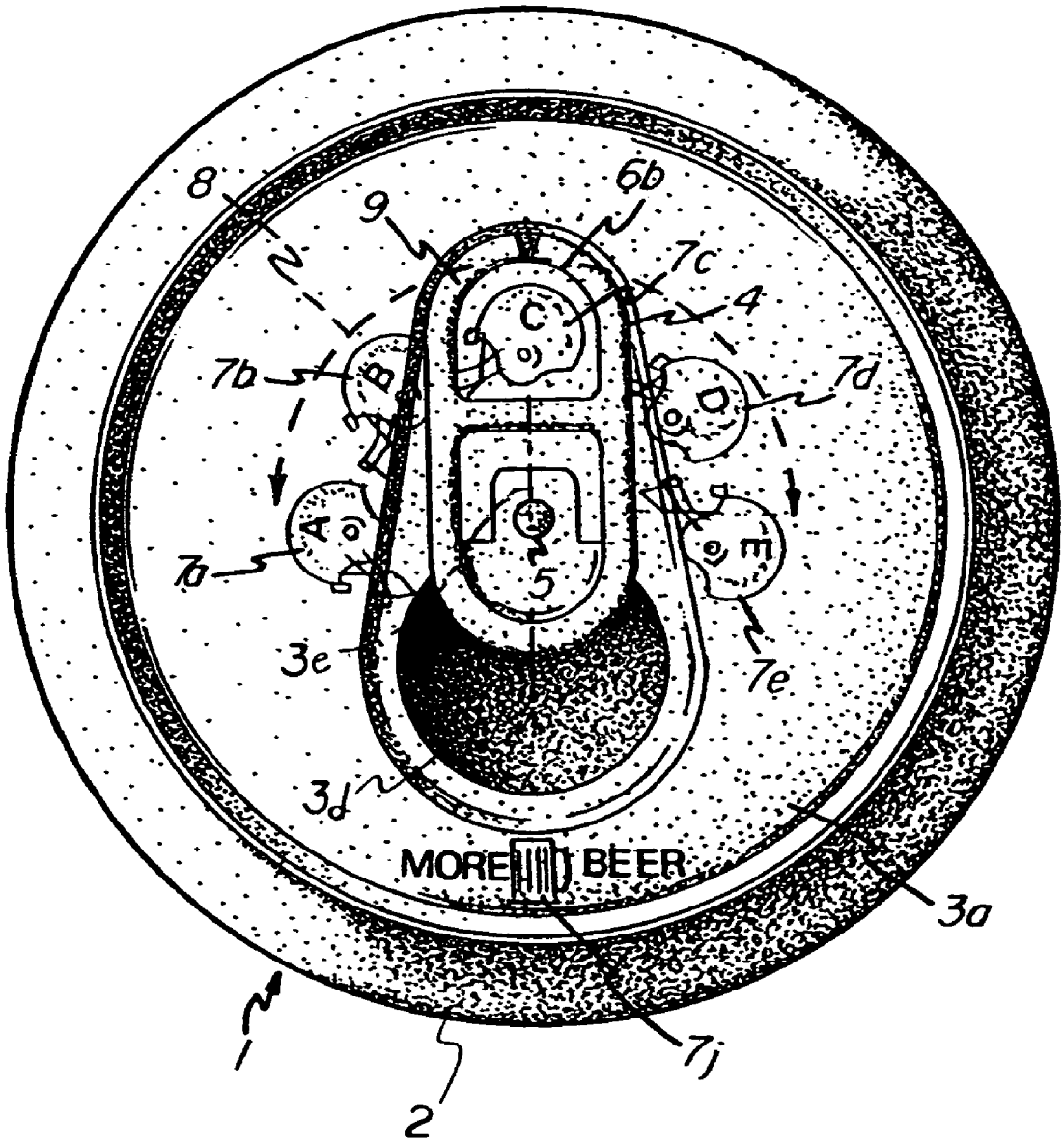
FIG. 3 is a top plan view of an easy opening can container demonstrating an alternative embodiment of the present invention.

Referring now to FIG. 3, a further illustrative embodiment of the invention with an alternate indicator 6*b* is displayed. The alternate indicator 6*b* comprises an aperture 9 formed within the tab 4. The aperture 9 is selectively movable into alignment with one of the plurality of visual indicia 7*a*-7*j* for providing a unique visual communication. More particularly, the selected visual indicia (7*c* as shown in FIG. 3) is visible through the aperture formed within the tab 4. In this further illustrative embodiment, the unique visual communication may operate to convey any of the aforementioned communications of the earlier described embodiment.

Figure 4:
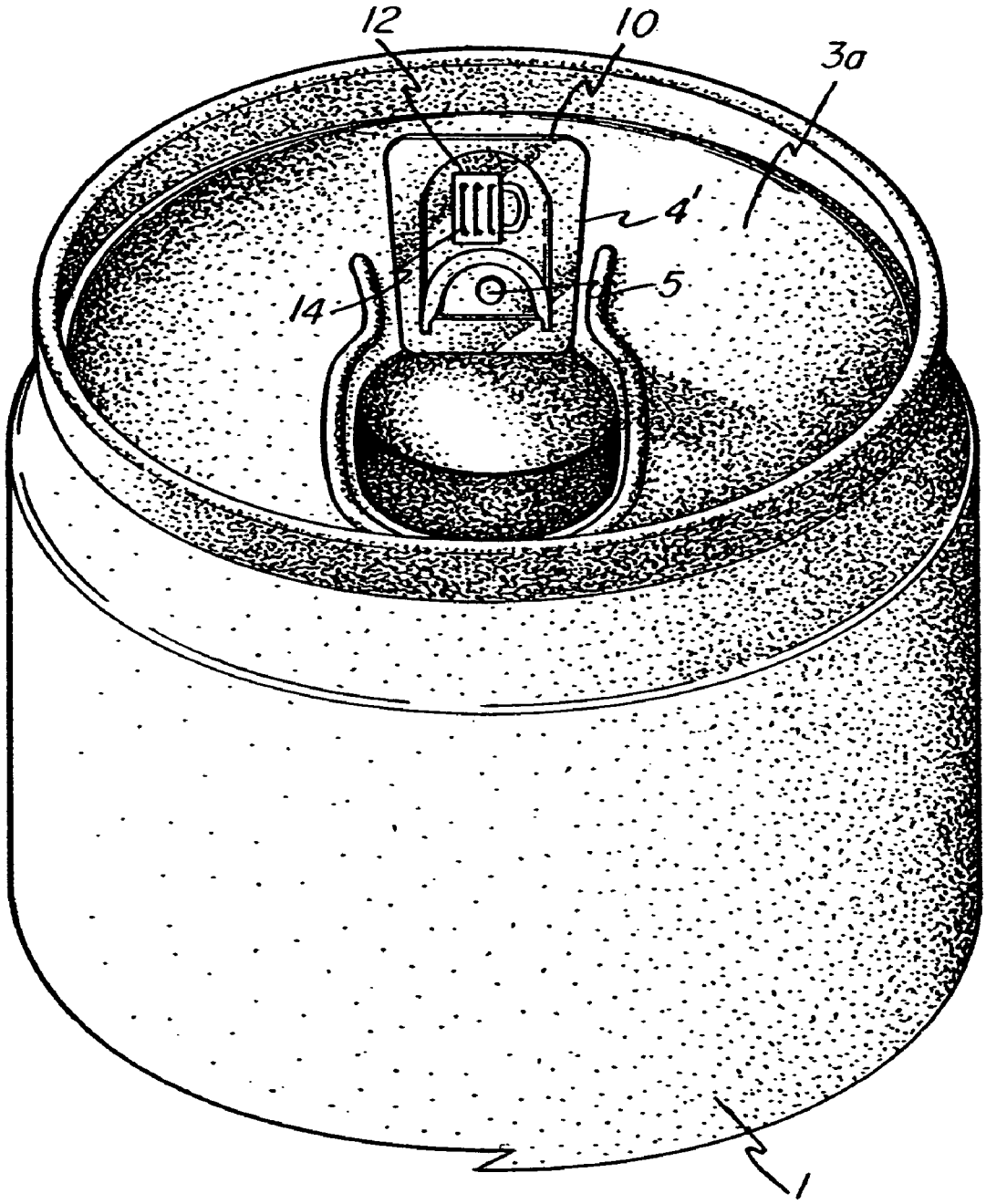
FIG. 4 is a perspective view of a further illustrative embodiment of an easy opening can container in accordance with the present invention, illustrating the upper surface of the tab pivotally moved into substantially perpendicular disposition with the upper end wall.
Figure 5:
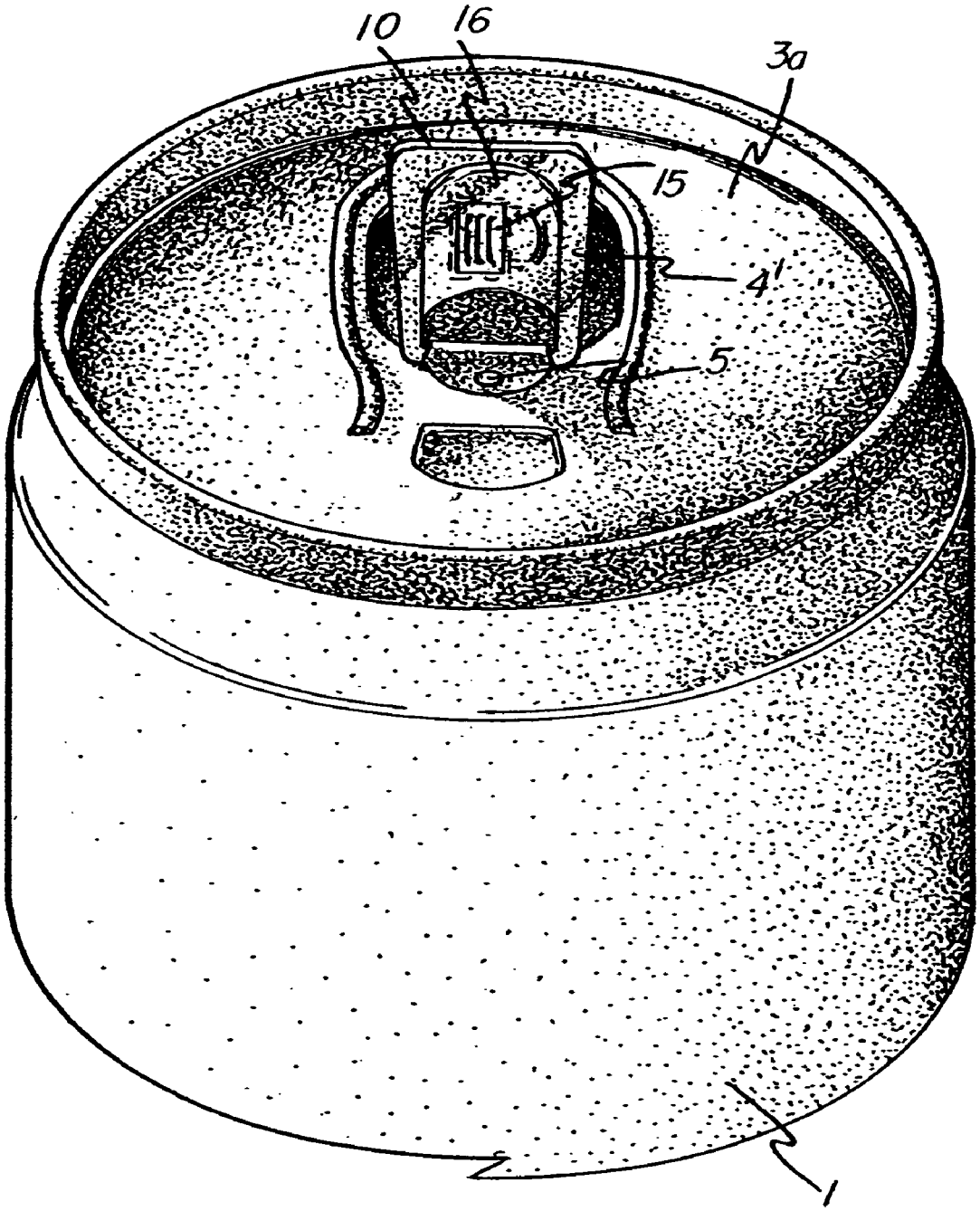
FIG. 5 is a perspective view of another illustrative embodiment of an easy opening can container in accordance with the present invention, illustrating the lower surface of the tab pivotally moved into substantially perpendicular disposition with the upper end wall.

Turning now to FIGS. 4 and 5, easy opening can container 1 is illustrated as having an alternative embodiment tab 4'. The tab 4' as illustrated has been pivoted into substantial perpendicular disposition with the upper end wall 3*a* of the can container 1. This movement is effected by manually pulling the outer edge 10 of the tab 4' upwardly away from the upper end wall 3*a* of the container 1. The resultant positioning of the tab 4' effects a unique visual communication. This communication may effect an order signal to a bar tender or server that the container 1 is empty or near empty and that another, or second, full container having the same contents is desired.

In the illustrative embodiment, an upper surface 12 of the tab 4' is further modified or shaped to support at least one visual indicia 14 which further emphasizes the order signal to a bar tender or server that the container 1 is empty or near empty and that another, or second, full container having the same contents is desired. The visual indicia 14 may consist of a mark, shape, incising, imprint, color, depression, cut, mold, impression, etc. visually forming a symbol, number, letter, word, name, graphic, or other visual cue. Examples of the visual indicia 14 include a full beer mug (as shown in FIG. 4), a full glass, the words "MORE DRINK", a racing-style finish flag, a "thumbs up" graphic, a "hand up" shape or image, a traffic signal showing a green light, a colored flag, a container image shaped similarly to the actual full size container, a unique color, etc. These examples of visual indicia are provided for illustrative purposes only and should not be construed as limiting the scope of the invention.

Figure 6:
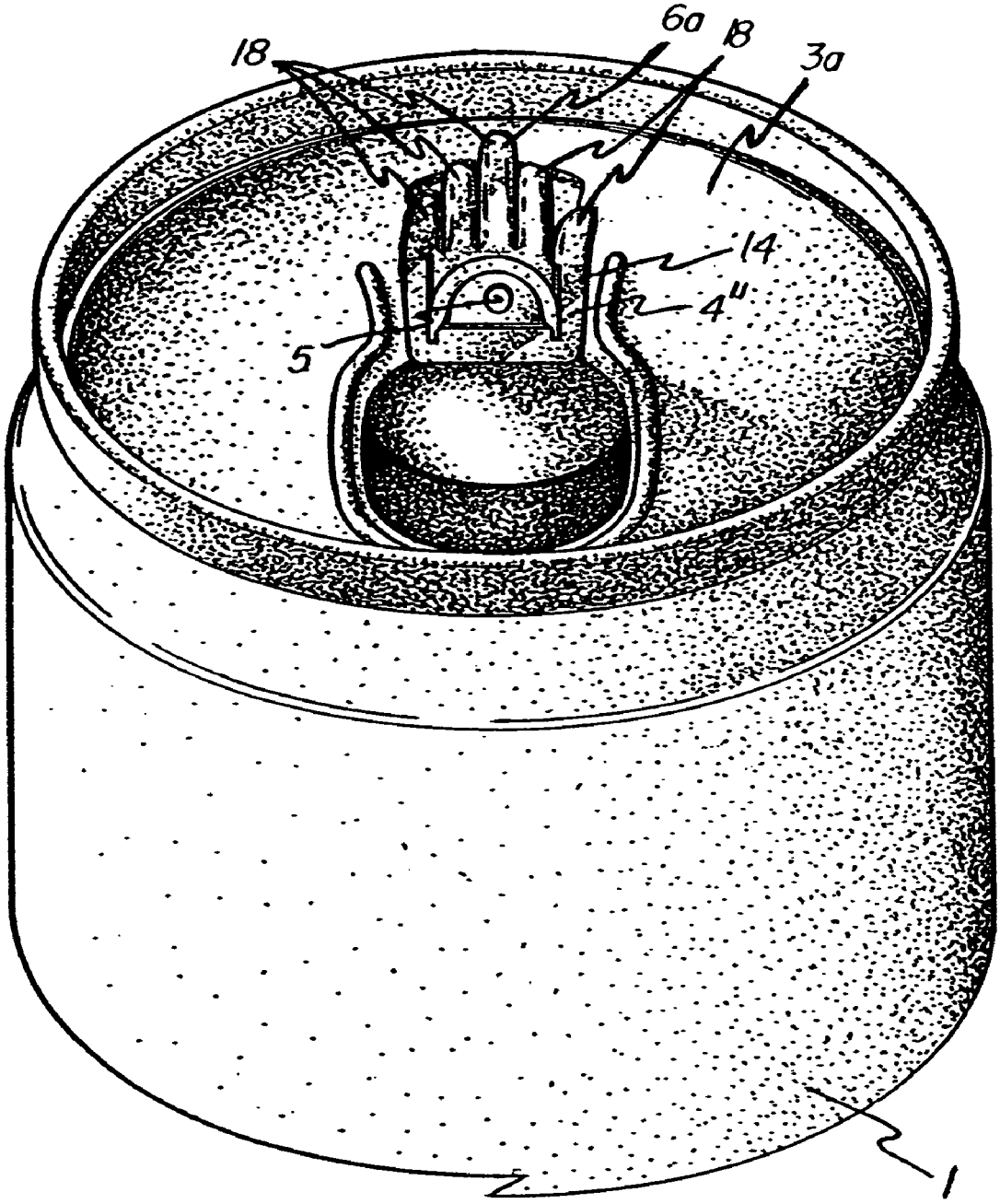
FIG. 6 is a perspective view of another illustrative embodiment of an easy opening can container in accordance with the present invention, illustrating visual indicia supported by the tab and comprising the shape of a hand.

The aforementioned "hand up" image is illustrated in greater detail in FIG. 6 wherein the tab 4" is shaped in the form of a person's hand including a plurality of parallel disposed fingers 18. At least one of the fingers 18 may serve as the indicator 6*a* identified above when the tab 4" is positioned in substantially parallel relation to the upper end wall 3*a* of the container 1. When the tab 4" is moved upwardly away from the upper end wall 3*a* into substantially perpendicular relation thereto, the fingers 18 serve to provide a unique visual communication to a server or other individual. More particularly, the fingers 18 in such an upright position signal that the container 1 requires replacement.

Referring further to FIG. 5, a further illustrative embodiment of the invention is shown wherein the visual indicia 15 resulting from the modification or shaping of the tab 4 is supported on the lower surface 16 of the tab 4. As such, the signal effected by the indicia 15 of tab 4 is only viewable when the tab 4 is placed into substantially perpendicular disposition with the upper end wall 3*a* of the can container 1.

Figure 7:
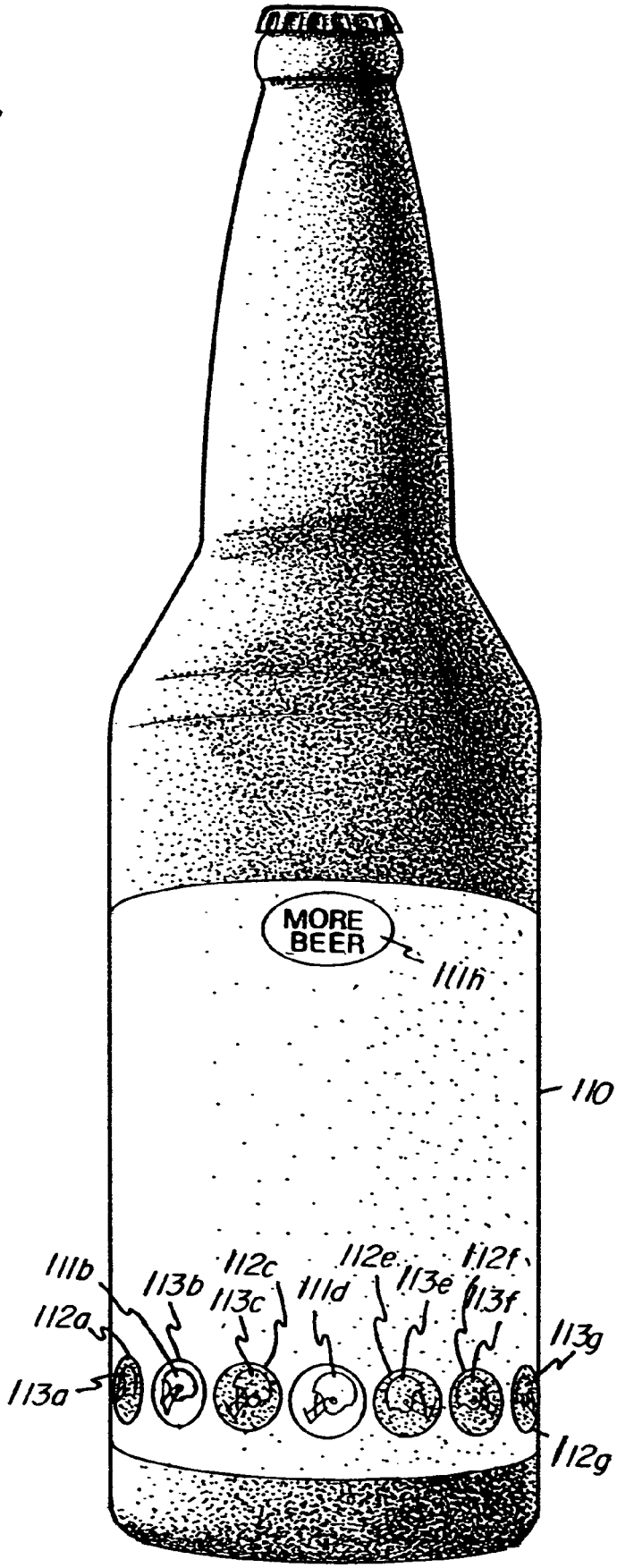
FIG. 7 is a side elevational view of a container label in accordance with a further illustrative embodiment of the present invention as applied to a conventional bottle.

Turning now to FIG. 7, a further illustrative embodiment of the present invention is illustrated as comprising a container label formed from a material sheet 110 which may be affixed to any conventional container. A first plurality of visual indicia 111*a*-111*g* (111*b* and 111*d* are shown in FIG. 7) preferably comprised of unique graphical images are positioned in series along a portion of the material sheet 110. Illustratively, the visual indicia 111*a*-111*g* comprise a plurality of visually appealing symbols, including a request symbol 111*h* signaling the desire for more beverage. Alternatively, the first plurality of visual indicia 111*a*-111*g* may comprise letters, numbers, words, names, symbols or other graphic representation.

A plurality of substantially opaque non water soluble scratch-off layers 112*a*-112*g* (112*a*, 112*c*, 112*e*, 112*f* and 112*g* are shown in FIG. 7) are disposed atop the first plurality of visual indicia 111*a*-111*g*. The first plurality of visual indicia 111*a*-111*g* are individually covered with the scratch-off layers 112*a*-112*g*. A second plurality of visual indicia 113*a*-113*g* (113*a*, 113*c*, 113*e*, 113*f*, and 113*g* are shown in FIG. 8) which are visually distinguishable from the first plurality of visual indicia 111*a*-111*g* are printed atop each of the respective scratch-off layers 112*a*-112*g*.

When one or more scratch-off layers 112*a*-112*g* are removed by a user of the container label, one or more of the first plurality of visual indicia 111*a*-111*g* are displayed. The displayed first plurality of visual indicia 111*a*-111*g* are visually distinguishable from the second plurality of visual indicia 113*a*-113*g*. For example, the first plurality of visual indicia 111*a*-111*g* indicia may have a color different from the second plurality of visual indicia 113*a*-113*g*. The distinction between the first plurality of visual indicia 111*a*-111*g* and the second plurality of visual indicia 113*a*-113*g* provides a unique visual communication.

Figure 8:
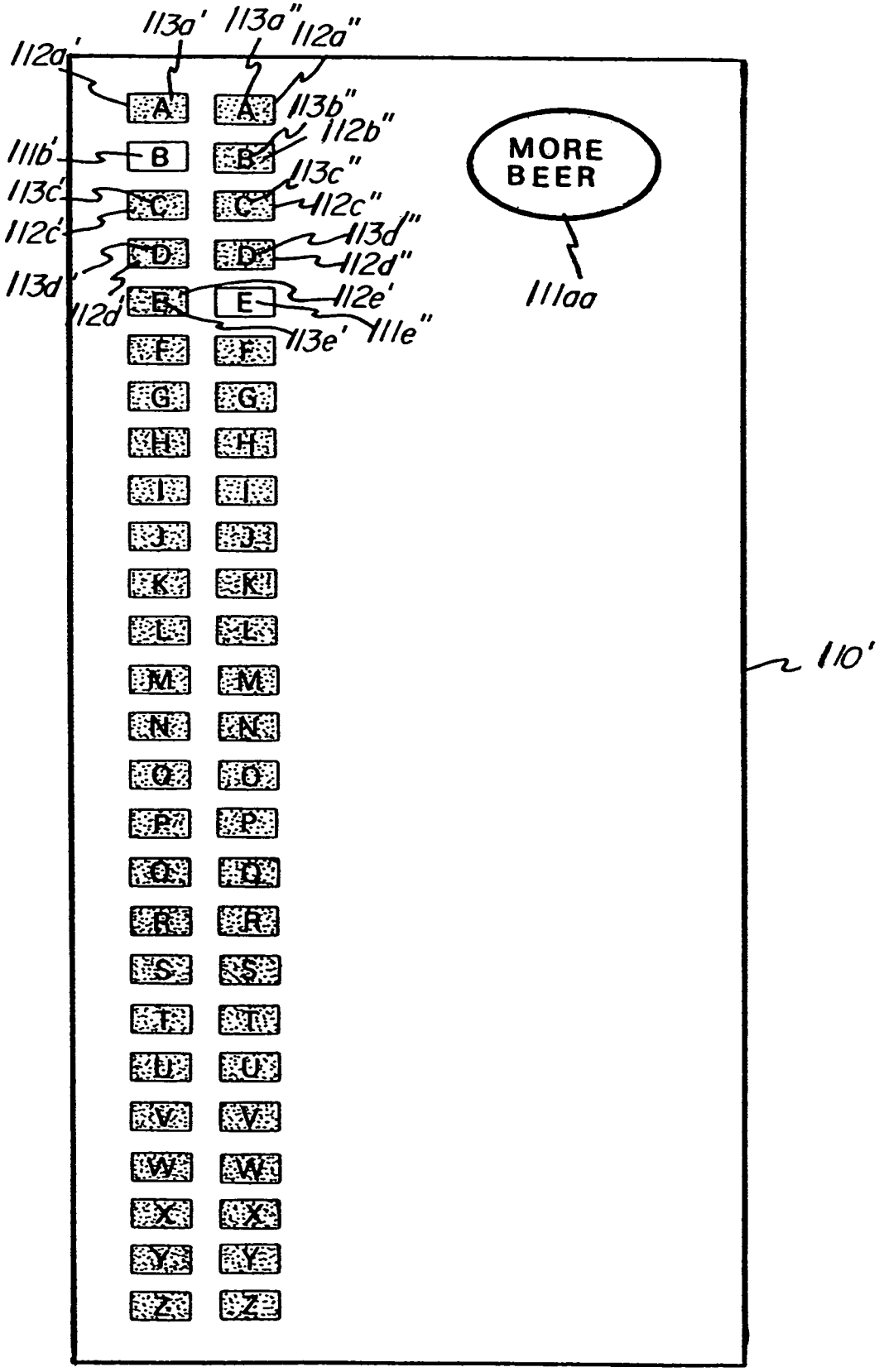
FIG. 8 is a top plan view of an alternative embodiment of the container label of the present invention.

FIG. 8 shows an alternative embodiment of the container label. A first plurality of visual indicia 111*a*'-111*z*' and 111*a*"-111*z*" (111*b*' and 111*e*41 are shown in FIG. 8) preferably comprised of one or more rows of the 26 letters of the alphabet are positioned in series along a portion of the material sheet 110'. The visual indicia may also comprise a request symbol 111*aa*, such as the phrase "more beer" signaling the desire for more beverage. Alternatively, the first plurality of visual indicia 111*a*'-111*z*' and 111*a*'-111*z*" may comprise letters, numbers, words, names, symbols or other graphic representation. It may be appreciated that one of the first plurality of visual indicia 111*a*'-111*z*' and 111*a*"-111*z*" may comprise a signal identifying the user of the container as the winner of a contest.

A plurality of substantially opaque non water soluble scratch-off layers 112*a*'-112*z*' and 112*a*"-112*z*" (all but 112*b*' and 112*e*" are shown in FIG. 8) are disposed atop the first plurality of visual indicia 111*a*'-111*z*' and 111*a*"-111*z*". The first plurality of visual indicia 111*a*'-111*z*' and 111*a*"-111*z*" are individually covered with the scratch-off layers 112*a*'-112*z*' and 112*a*"-112*z*". A second plurality of visual indicia 113*a*'-113*z*' and 113*a*"-113*z*" (all but 113*b*' and 113*e*" are shown in FIG. 8) which are visually distinguishable from the first plurality of visual indicia 111*a*'-111*z*' and 111*a*"-111*z*" are printed atop each of the respective scratch-off layers 112*a*'-112*z*' and 112*a*"-112*z*".

When one or more scratch-off layers 112*a*'-112*z*' and 112*a*"-112*z*" are removed by a user of the container label, one or more of the first plurality of visual indicia 111*a*'-111*z*' and 111*a*"-111*z*" are displayed. The displayed first plurality of visual indicia 111*a*'-111*z*' and 111*a*"-111*z*" are visually distinguishable from the second plurality of visual indicia 113*a*'-113*z*' and 113*a*"-113*z*". The distinction between the first plurality of visual indicia 111*a*'-111*z*' and the second plurality of visual indicia 113*a*'-113*z*' and 113*a*"-113*z*" provides a unique visual communication.

In this alternate embodiment, the unique visual communication may operate to convey the first letter of the given name (i.e., first name) and the surname (i.e., last name) of the user of the container, thus distinguishing the container from other like containers, or it may signal the user's desire for another container having the same contents to an attending bar tender or server.

Alternatively, the selected visual indicia may operate to convey information pertaining to the contents of the container, for example, the date of purchase, the date the container was first opened, the volume of the contents of the container either consumed or remaining, or the concentration of a solute or solvent contained within the container. However, it should be appreciated that the selected visual indicia may be used to convey any other communication, for example, "I Love You", "Interested", "Not Interested", "Finished", etc.

Figure 9:
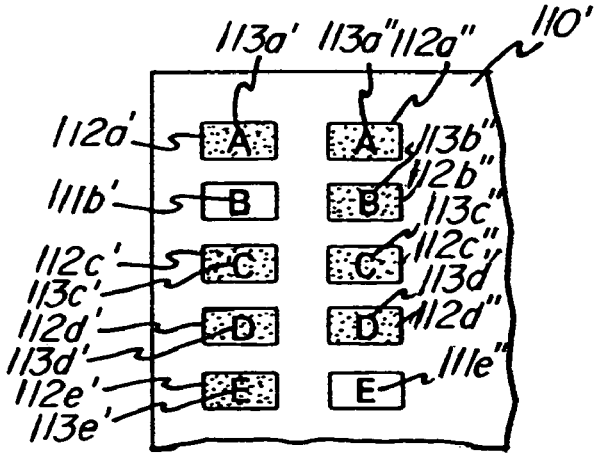
FIG. 9 is an enlarged view of an illustrative embodiment of the container label of the present invention demonstrating a post scratch-off state.

FIG. 9 shows an enlarged view of the container label after a pair of scratch-off layers 112*b*', 112*e*" have been removed by a user of the container, thus displaying members of the first plurality of visual indicia 111*b*', 111*e*" positioned there under.

Figure 10:
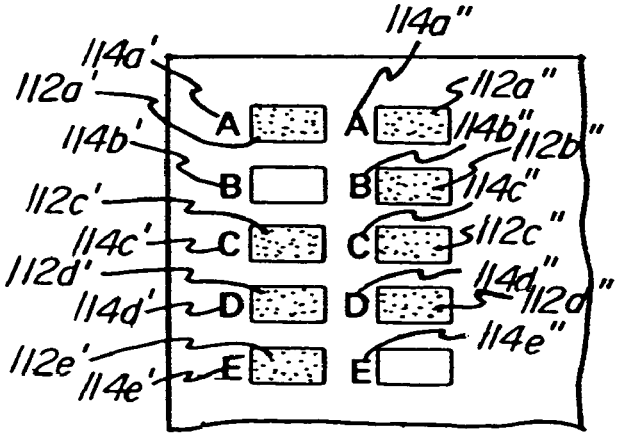
FIG. 10 is an enlarged view of an alternate embodiment of a container label in accordance with the present invention.

Referring to FIG. 10, a separate embodiment of this invention has an alternate second plurality of visual indicia 114*a*'-114*e*' and 114*a*'-114*e*" printed in spatial alignment with each of the scratch off layers 112*a*'-112*e*' and 112*a*"-112*e*" (all but 112*b*' and 112*e*" are shown in FIG. 10). When a user of the label scratches off one or more of the scratch-off layers 112*a*'-112*e*' and 112*a*"-112*e*" a unique visual communication is provided. In this embodiment, it is not necessary that the first plurality of visual indicia be present, as the removal of the scratch-off layers 112*a*-112*e* and 112*a*"-112*e*" in itself is sufficient to convey a unique visual communication.

In this alternative embodiment, the unique visual communication may operate to convey any of the aforementioned communications of the preferred embodiment.

Figure 12:
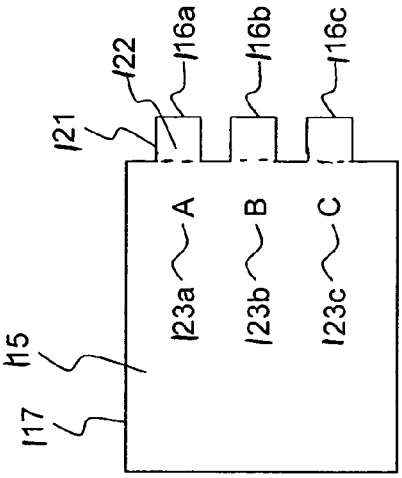
FIG. 12 shows a detailed view of FIG. 11.
Figure 11:
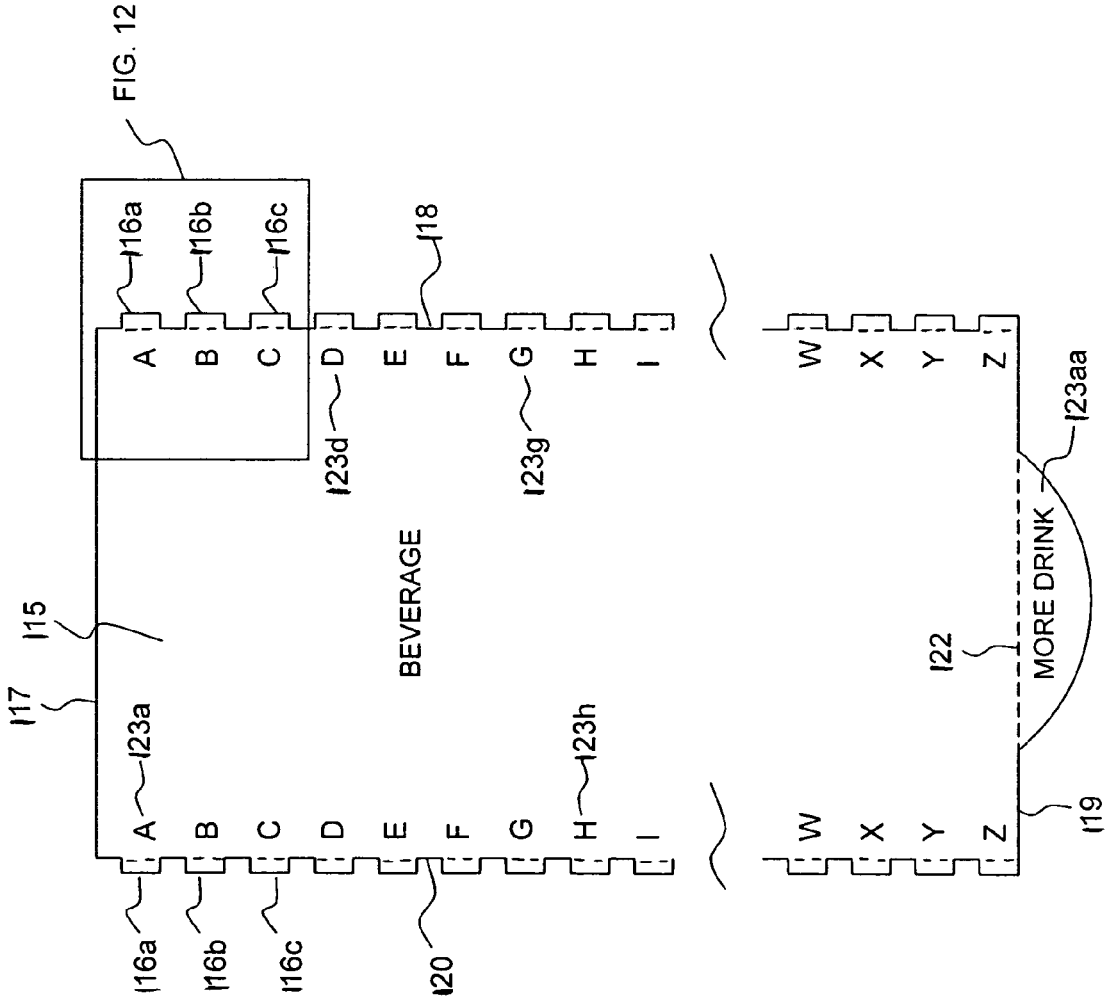
FIG. 11 shows another embodiment of a container label of this invention having a plurality of fingers.

FIGS. 11 and 12 illustrate an alternate container label in accordance with this invention. The container label is formed from a material sheet 115 having a plurality of fingers 116*a*, 116*b*, 116*c* . . . etc. along one or more of the material sheet's outer edges (117, 118, 119, 120). The fingers 116*a*, 116*b*, 116*c* . . . etc. are detachable from the material sheet 115 by tearing them away along points of attachment 121. The fingers may be of varying shape and design. In this embodiment, the points of attachment 121 preferably comprise score lines 122 to weaken the fingers 116*a*, 116*b*, 116*c* . . . etc. for removal from the material sheet 115. Alternatively, the points of attachment 122 may have a thinned wall or a perforated line to weaken the fingers 116*a*, 116*b*, 116*c* . . . etc. for removal from the material sheet 115.

Additionally, the adhesive attaching the container label to a container may be applied minimally, or not at all, to the fingers 116*a*, 116*b*, 116*c* . . . etc., to thus weaken the fingers for removal from the material sheet 115. Disposed alongside the fingers 116*a*, 116*b*, 116*c* . . . etc. are a plurality of visual indicia 123*a*, 123*b*, 123*c* . . . etc. comprised of the 26 letters of the alphabet and the word phrase "more drink" 123*aa*. Alternatively, the plurality of visual indicia may be comprised of letters, numbers, words, names, symbols or other graphic representation. The plurality of visual 123*a*, 123*b*, 123*c* . . . etc. are aligned in parallel with said fingers 116*a*, 116*b*, 116*c* . . . etc. When a user of the container label removes one or more of the fingers 116*a*, 116*b*, 116*c* . . . etc., a unique visual communication is provided.

In this alternate embodiment, the unique visual communication may operate to convey the first letter of the name and surname of the user of the container, thus distinguishing the container from other like containers, or it may signal the user's desire for another container having the same contents to an attending bar tender or server.

Alternatively, the visual communication selected may comprise any combination of the following: letters, numbers, words, names, symbols or other graphic representation. The visual combination may be used to convey the identity of the user of the container.

Alternatively, the visual combination may convey information pertaining to the contents of the container, for example, the date of purchase, the date the container was first opened, the volume of the contents of the container either consumed or remaining, or the concentration of a solute or solvent contained within the container. However, it should be appreciated that the visual combination may be used to convey any other visual signal, for example, holiday symbols, cartoon caricatures, "I Love You", "Interested", "Not Interested", "Finished", etc.

While the forms of apparatus described herein, and methods related thereto, constitute preferred embodiments of the invention, it should be appreciated that this in no way limits the scope of the invention as described in the appended claims.

The invention claimed is:

1. A method for signaling an order for a beverage, the method comprising the steps of: providing a beverage container; providing a label on said beverage container; providing an opaque scratch-off layer on said label; providing a first request indicia atop said scratch-off layer; providing a second request indicia beneath said scratch-off layer, said first request indicia being substantially identical to said second request indicia; removing said scratch-off layer; and signaling an order to a server requesting another beverage container, said signaling step comprising the step of conveying an order signal represented by said second request indicia following the step of removing said scratch-off layer.

2. The method of claim 1, wherein said second request indicia includes a textual representation of a request for a beverage.

3. The method of claim 1, wherein said second request indicia includes a graphical representation of a request for a beverage.

4. The method of claim 3, wherein said second request indicia includes a symbol of a beverage.

5. The method of claim 1, wherein the beverage container comprises a bottle.

6. The method of claim 1, wherein said scratch-off layer is non-water soluble.

7. The method of claim 1, wherein the first request indicia has a color different from the second request indicia.

* * * * *

UNITED STATES PATENT AND TRADEMARK OFFICE

CERTIFICATE OF CORRECTION

PATENT NO. : 7,617,622 B2
APPLICATION NO. : 11/084912
DATED : November 17, 2009
INVENTOR(S) : Brian K. Elias It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 844 days.

Signed and Sealed this

Nineteenth Day of October, 2010

David J. Kappos

David J. Kappos
*Director of the United States Patent and Trademark Office*